US008967286B2

(12) United States Patent
Kois

(10) Patent No.: US 8,967,286 B2
(45) Date of Patent: Mar. 3, 2015

(54) LATERAL MOUNT FOR VEHICLE MOUNTED IMPLEMENT

(71) Applicant: Kois Brother Equipment Co., Commerce City, CO (US)

(72) Inventor: Ernest J. Kois, Boulder, CO (US)

(73) Assignee: Kois Brothers Equipment Co., Inc., Commerce City, CO (US)

( * ) Notice: Subject to any disclaimer, the term of this patent is extended or adjusted under 35 U.S.C. 154(b) by 0 days.

(21) Appl. No.: 13/784,421

(22) Filed: Mar. 4, 2013

(65) Prior Publication Data

US 2014/0245644 A1 Sep. 4, 2014

(51) Int. Cl.

| | |
|---|---|
| ***A01B 21/00*** | (2006.01) |
| ***E01H 5/04*** | (2006.01) |
| ***E01H 1/05*** | (2006.01) |
| ***E01H 5/06*** | (2006.01) |

(52) U.S. Cl.

CPC . *E01H 1/05* (2013.01); *E01H 5/061* (2013.01)

USPC ..... 172/272; 37/231

(58) Field of Classification Search

CPC ..... E01H 5/066; E01F 3/3604; E01F 3/7654; E01F 3/8157; E01F 3/386

USPC ..... 37/279, 466, 266, 443, 231–235, 281, 37/189, 462, 464, 347, 355; 172/667, 795, 172/815, 782, 786, 684.5, 816, 271, 272; 414/695, 722, 724

See application file for complete search history.

(56) References Cited

U.S. PATENT DOCUMENTS

| | | | | |
|---|---|---|---|---|
| 3,669,194 | A | 6/1972 | Zurek | |
| 4,248,311 | A | 2/1981 | Frisbee et al. | |
| 4,439,939 | A | 4/1984 | Blau | |
| 4,660,248 | A | 4/1987 | Young | |
| 4,796,808 | A | 1/1989 | Linda et al. | |
| 4,999,935 | A | 3/1991 | Simi et al. | |
| 5,136,795 | A | 8/1992 | Rosenberg | |
| 5,279,014 | A | 1/1994 | Wise et al. | |
| 5,392,538 | A | 2/1995 | Geerligs et al. | |
| 5,477,600 | A | 12/1995 | Houle et al. | |
| 5,809,672 | A | 9/1998 | Jones | |
| 5,930,922 | A | 8/1999 | Altheide | |
| 6,012,240 | A | 1/2000 | Klug et al. | |
| 6,412,199 | B1 | 7/2002 | Quenzi et al. | |
| 6,484,421 | B1 | 11/2002 | Donoghue | |
| 6,711,837 | B2 | 3/2004 | Bloxdorf et al. | |
| 6,789,336 | B2 * | 9/2004 | Collins et al. | 37/352 |
| 6,901,728 | B2 | 6/2005 | Kelderman | |
| 6,907,941 | B1 | 6/2005 | Hoffart | |
| 6,944,978 | B2 | 9/2005 | LeBlond et al. | |
| 7,429,158 | B2 | 9/2008 | McFarland | |
| 7,578,078 | B2 * | 8/2009 | Gandolfi | 37/281 |
| 7,603,798 | B2 | 10/2009 | Schmeichel | |
| 7,631,442 | B2 | 12/2009 | Kost et al. | |
| 7,658,236 | B2 | 2/2010 | Howson et al. | |
| 7,681,337 | B2 | 3/2010 | Watson | |
| 7,784,199 | B2 | 8/2010 | Schmeichel | |

(Continued)

FOREIGN PATENT DOCUMENTS

DE 3738734 A1 6/1989

*Primary Examiner* — Robert Pezzuto

(74) *Attorney, Agent, or Firm* — Russell T. Manning; Marsh Fischmann & Breyfogle LLP

(57) ABSTRACT

A mount assembly is provided that allows for interconnecting an implement (e.g., snow plow, rotary brush etc.) to the front end of a vehicle while permitting that implement to move laterally relative to the front end of the vehicle.

17 Claims, 8 Drawing Sheets

(56) References Cited

U.S. PATENT DOCUMENTS

| | | | |
|---|---|---|---|
| 7,797,859 | B2 | 9/2010 | LeBlond et al. |
| 8,037,625 | B2 | 10/2011 | Schmeichel |
| 8,096,066 | B2 | 1/2012 | Gandolfi |
| 2003/0226289 | A1 | 12/2003 | Geerligs |
| 2005/0066554 | A1 | 3/2005 | Schmeichel |

* cited by examiner

LATERAL MOUNT FOR VEHICLE MOUNTED IMPLEMENT

FIELD

The present disclosure relates generally to attachment devices for attaching an implement to a vehicle and related implements. More specifically, the present disclosure is directed to an implement attachment device that allows for lateral or side-to-side movement between an implement and the vehicle to which it is attached.

BACKGROUND

Highway snow and ice control is typically performed by governmental entities (states, municipalities, etc.) utilizing plows to remove snow and ice and/or sanders that apply particulates to roadways. In the latter regard, such particulate may be a mixture of sand and/or salts (e.g., sodium chloride, calcium magnesium acetate (CMA)), which may melt snow/ice on a roadway. In addition to snow removal and particulate application, such governmental entities also attend to the cleaning of residual particulates (e.g., sand) from roadways. For instance, it is common for highways to be swept in the spring to remove accumulated particulate from roadway surfaces. Such sweeping is commonly performed utilizing a rotating brush assembly typically to a front end of a vehicle.

As plowing and sweeping operations often occur at different time of the year, it is common for governmental entities to utilize the same vehicles for both operations. For example, during winter operations, dump trucks utilized for sanding are often fitted with a snow plow disposed on their front end such that sanding and plowing may be done simultaneously. Further, once snow removal season ends, the plows are typically removed from these trucks such that sweepers may be attached to the front end of these trucks. As will be appreciated, such dual use of the vehicle reduces capital costs for the governmental entity.

In the case of plowing or sweeping, the truck mounted plow/sweeper must be short enough to allow transport on public highways which have limited lane width. Further, during plowing or sweeping, it is generally desirable to angle the implement such that the snow or particulate is moved toward the right shoulder of the road as the vehicle moves down the road. However, angling of the implement further shortens the lateral width of the implement. In this regard, it is often necessary to make multiple passes to clear the road. Further, in order to completely remove the snow/particulate from the roadway, it is often necessary for a truck operator to drive on the very edge of the roadway shoulder. Such operation can damage the shoulder which typically does not have the same base as the roadway and can be dangerous to operators if the tire of the vehicle leaves the roadway.

SUMMARY

Aspects of the presented inventions are directed to the provision of a mount assembly that allows for interconnecting an implement (e.g., snow plow, rotary brush etc.) to the front end of a vehicle while permitting that implement to move laterally relative to the front end of the vehicle. In this regard, such an implement may be moved laterally to the side of the vehicle (e.g., passenger side) during use such that the implement extends further towards the shoulder of a roadway surface. However, during transit, the implement may be moved to a center position relative to the vehicle.

According to a first aspect, a mount assembly is provided that allows for providing lateral movement between a vehicle and an implement attached to that vehicle. The assembly includes an attachment mount having a rearward surface that is adapted for removable attachment to a vehicle. A track is fixedly connected to a forward surface of the attachment mount and extends laterally across the forward surface thereof. This track may be integrally formed with the attachment mount or may be a separate member that is fixedly interconnected thereto. In any arrangement, a slide member is moveably attached to the track such that the slide member may move between a first position and a second position along the length of the track and hence relative to the attachment mount and/or front end of a vehicle. A moving frame has a rearward surface that is fixedly connected to the slide member. Accordingly, this moving frame is likewise adapted to move between a first position and a second position relative to the attachment mount. In order to effect movement between the moving frame and the attachment mount, the assembly utilizes an actuator interconnected to these members. In one arrangement, this actuator is formed of a hydraulic cylinder that allows for controllably moving the moving frame relative to the attachment mount. However, any appropriate actuator may be utilized including, without limitation rack and pinion type actuators. A mount is disposed on the forward surface of the moving frame for selectively mounting an implement thereto. In this regard, once the implement is mounted to the moving frame, the implement may move between the first and second lateral positions in conjunction with movement of the moving frame.

The slide member may be formed of any element that allows for movement between first and second positions. That is, any track and carriage arrangement may be utilized. In one arrangement, the slide member is formed of a shaft that extends between first and second positions on the attachment mount. In this arrangement, the slide member also includes a linear bearing that is adapted to move along the length of the shaft. In such an arrangement, the moving frame is fixedly interconnected to each linear bearing. In a further arrangement, the slide member includes first and second parallel shafts and the moving frame is fixedly interconnected to linear bearings on each shaft.

In a further arrangement, in addition to allowing for lateral movement between the implement mounted to the moving frame and the attachment mount, the mounting assembly further allows for pivotal movement of the implement about a first axis relative to the attachment mount. In this arrangement, an implement connected to a front surface of the moving frame is adapted to move between a first angular position and a second angular position relative to the moving frame. In such an arrangement, a second actuator is operative to move the implement between the first and second angular positions. In another arrangement, the implement is further pivotally connected to the moving frame about a second axis such that the implement may move between third and fourth angular positions relative to the moving frame. In this regard, the implement may tilt up and down relative to the moving frame.

Any appropriate implement may be interconnected to the moving frame. In one arrangement, the implement is a snow plow. In another arrangement, the implement is a rotating brush assembly.

According to another aspect, a laterally adjustable implement is provided for attachment to a front end of a vehicle. The implement includes a mounting plate having a rearward surface that is adapted for removable attachment to a vehicle. A moving frame has a rearward portion that is movably attached to a forward surface of the mounting plate. In this regard, the moving frame is adapted to move between a first lateral position and a second lateral position relative to the mounting plate. This movement is controlled by a first actuator that displaces the moving frame between the first and second lateral positions. An implement is pivotally connected to a forward surface of the moving frame such that the implement is operable to move between a first angular position and second angular position relative to the moving frame. A second actuator is operative to move the implement between the first and second angular positions.

In a further arrangement, the implement is interconnected to the moving frame via a two-axis movable mount (e.g., clevis) that allows for movement between the first and second angular positions and third and fourth angular positions. In this regard, the implement may tilt between first and second horizontal positions relative to the front end of a vehicle and/or tilt up and down relative to the front end of a vehicle. In such an arrangement, another actuator may be utilized to control movement about this second axis.

According to another aspect, a method is provided for retrofitting an implement to provide lateral movement between the implement and the front end of a vehicle to which the implement is attached. The method includes removing an attachment element from the implement that is adapted to attach the implement to the vehicle. In conjunction with removal of this attachment element, a sliding attachment mount is provided that allows for interconnection to the front end of the vehicle and interconnection to the implement. The slide assembly permits lateral movement between an attachment mount adapted for attachment to the vehicle and a moving frame to which the implement is attached.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1:
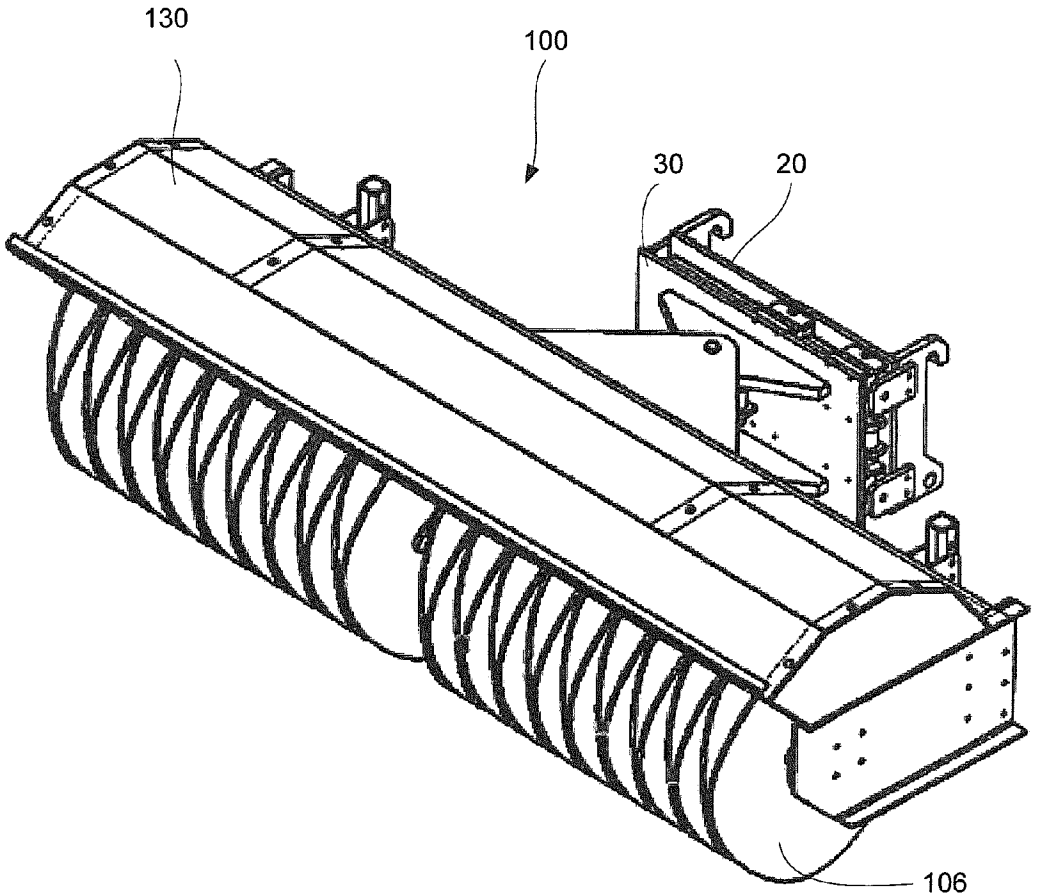
FIG. 1 illustrates a perspective view of a vehicle mounted implement.

FIGS. 1 illustrates one embodiment of a laterally adjustable mount and corresponding implement that is adapted to be interconnected to the front end of a vehicle. In the illustrated embodiment, the implement is a rotary brush assembly that is adapted for sweeping debris off of a road way surface. However, it will be appreciated that various aspects of the presented inventions are equally applicable to other implements. For instance, rather than incorporating a rotary brush, the system may utilize a snow plow.

Figure 2A:
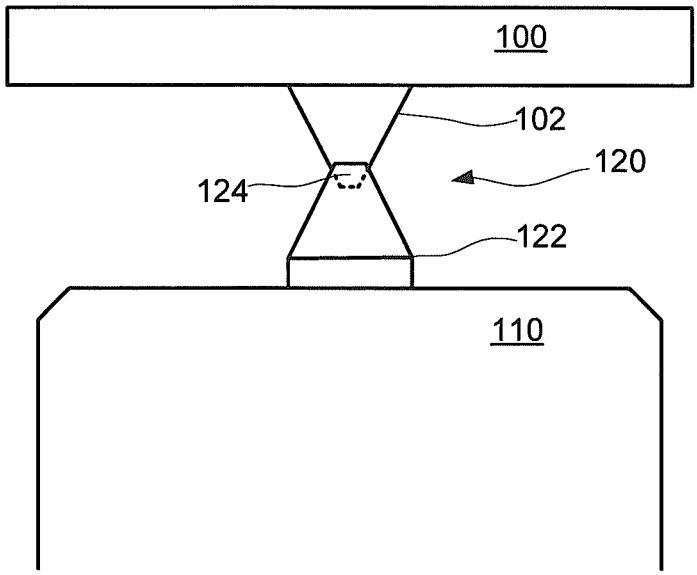
Figure 2A (Prior Art)
FIGS. 2A and 2B illustrate a top view of a prior art attachment mount assembly for mounting an implement to a vehicle.
Figure 2B:
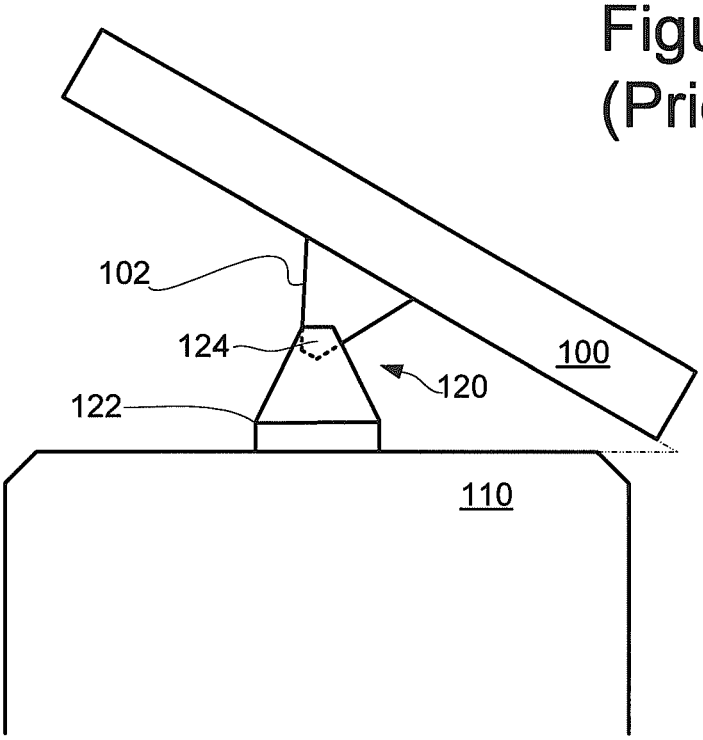
Figure 2B (Prior Art)

Aspects of the presented inventions are based on the realization that existing mounts for attaching an implement such as a rotary brush or snow plow to the front end of a vehicle provide limited motion between the vehicle and the implement. In a common mounting arrangement, as illustrated in FIG. 2, an implement 100 is interconnected to the front end of a vehicle 110, where the implement 100 is pivotally interconnected to the vehicle 110 via a mounting arrangement 120. Generally, such a mounting arrangement 120 includes a vehicle mounted frame 122 that is either fixedly or removably interconnected to the front end of the vehicle 110. In order to provide pivotal movement between the vehicle 110 and the implement, the frame 122 also includes a pivot mount 124 to which a frame 102 of the implement 100 is pivotally interconnected. In operation, various actuators (e.g., hydraulic actuators; not shown) extend between the implement frame 102 and the mount 124 in order to adjust the angular position of the implement 100 relative to the vehicle 110 as illustrated in FIG. 2B.

In previous arrangements, it has been common for the implement 100 to be slightly wider than the vehicle 110. However, the width of the implement 100 is limited by the requirement that the vehicle be transportable on public highways. Accordingly, the width of the implement 100 may only be slightly wider than the width of the vehicle 110. In this regard, when the implement 100 is angled relative to the vehicle 110 as illustrated in FIG. 2B, the implement 100 may minimally extend past the passenger side edge of the vehicle 110. Accordingly, this has required operators of such a vehicle 110 drive the vehicle very close to the edge of the road in order to fully remove debris (e.g., particulate or snow) from a roadway surface. Further, in the case of a rotating brush, adequately sweeping particulate from the roadway surface to the road shoulder has required that the brush 100 be disposed at a significant angular offset relative to the front end of the vehicle. That is, as the brush rotates, particulate is thrown forward and to the side in a direction that is generally normal to the lateral width of the brush. As the brush only slightly extends beyond the edge of the vehicle, a large relative angle is required between the brush and the vehicle to ensure the particulate is thrown far enough to leave the roadway surface. Such a large relative angle between the brush and the front end of the vehicle results in significant brush wear. Specifically, the brush tends to wear in a conical manner. This 'coning' requires periodic replacement of the brush.

Figure 3A:
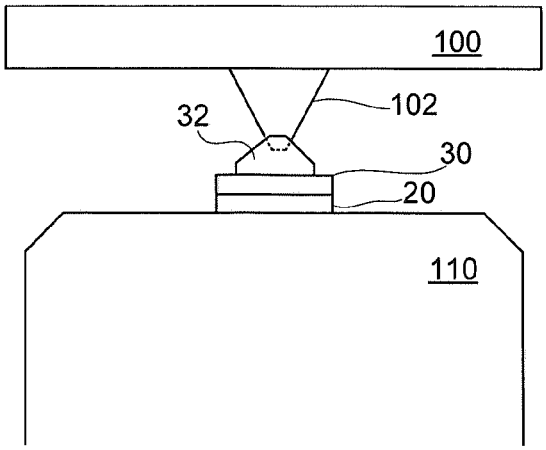
FIGS. 3A-3C illustrate a top view of a laterally adjustable attachment mount assembly for mounting an implement to a vehicle.
Figure 3B:
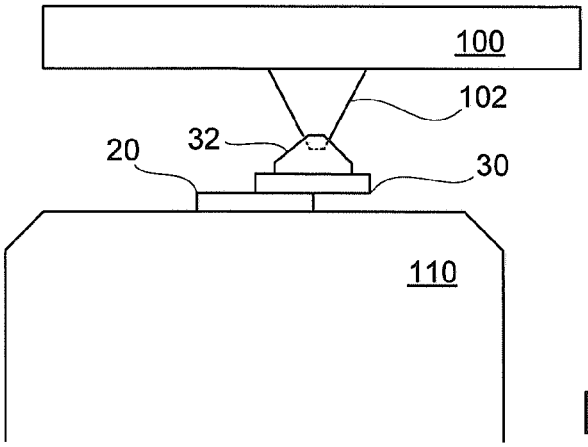
Figure 3C:
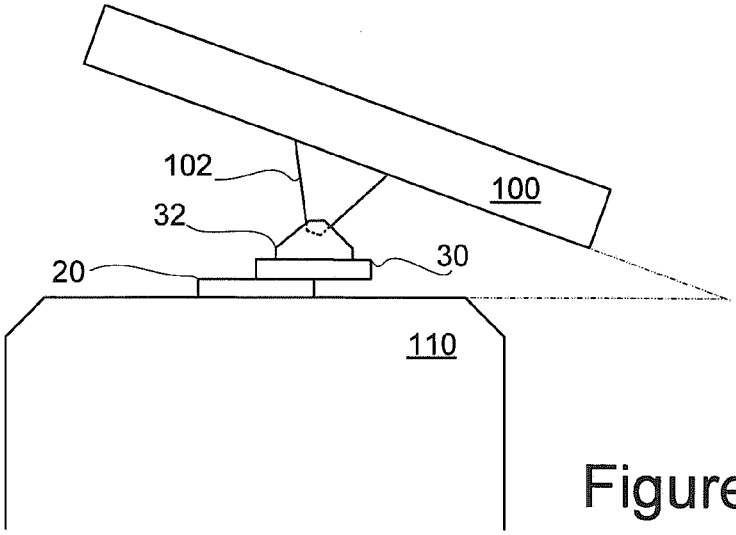

FIGS. 3A-3C illustrate the attachment of an implement 100 to the front end of a vehicle 110 utilizing a sliding lateral mount assembly 10. As shown, the sliding lateral mount assembly 10 utilizes an attachment mount 20 that is interconnected to the vehicle 110 and a moving frame 30 is slideably interconnected to the attachment mount 20. The moving frame 30 further includes a mounting plate 32 that extends forward from the moving frame 30 to provide a pivotal attachment point for interconnection with an implement frame 102.

As show in FIG. 3B, the moving frame 30 is adapted to move from a first position to a second position relative to the attachment mount 20 and thereby dispose the implement 100 from a first position to a second position relative to the front end of the vehicle 110. In this regard, the distance that the implement 100 extends beyond the passenger side edge of the vehicle is increased in relation to prior mounting arrangements. Accordingly, during operation, the implement 100 may be moved toward the passenger edge of the vehicle and thereby provide improved removal of snow and or particulates from a roadway surface while allowing the vehicle to remain a safe distance from the roadway edge. Likewise, the implement may be moved toward the driver edge of the vehicle. Further, in the case of the rotating brush implement 100, the ability to move the brush a greater distance beyond the side edge of the vehicle allows for reducing the relative angle between the brush and the front end of the vehicle while still removing particulate from the road surface. Stated otherwise, this allows for reducing the angular offset between the brush 100 and the front of the vehicle 110 which thereby reduces coning wear of the brush. This prolongs the life of the brush and provides improved removal of debris from the roadway surface.

Figure 4:
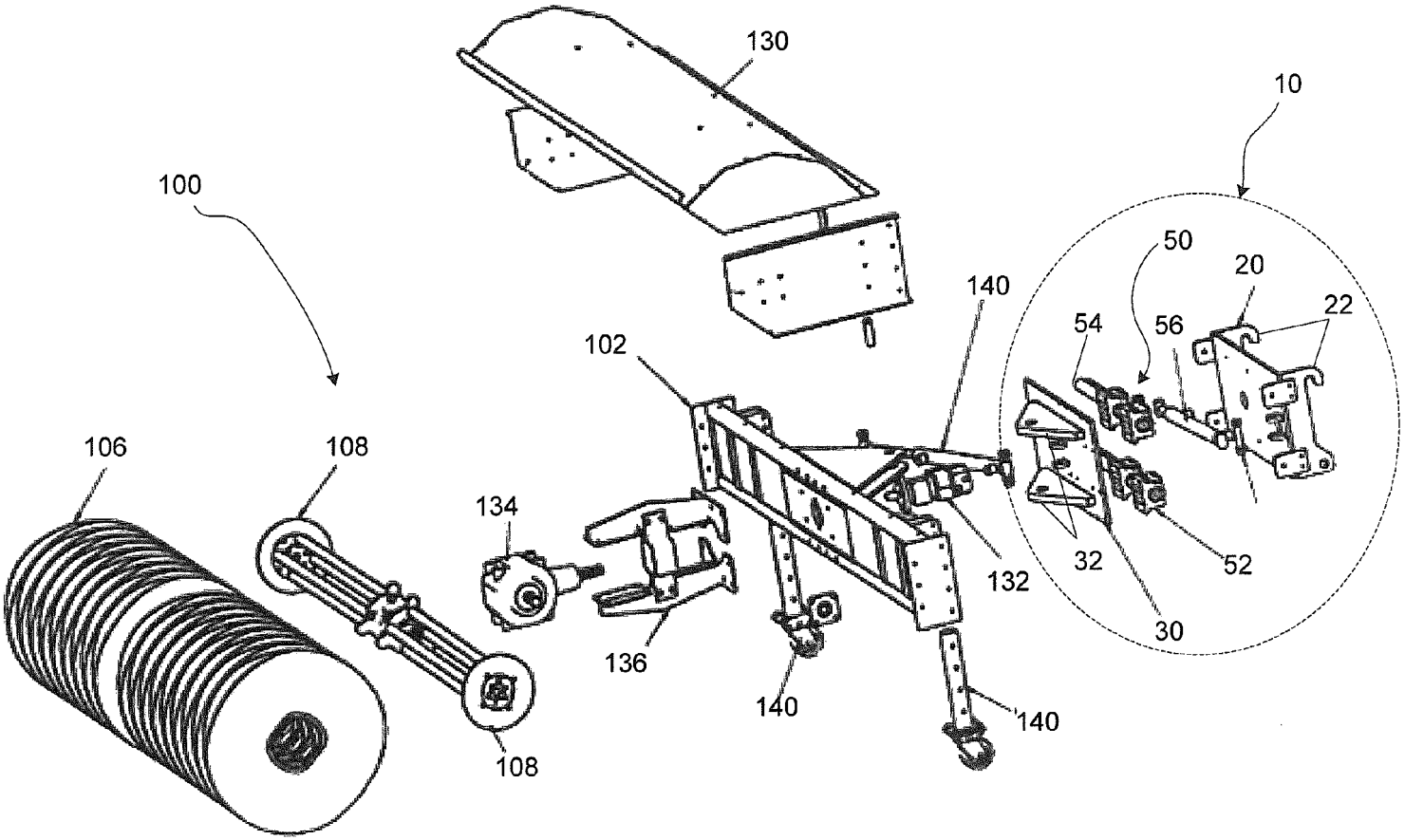
FIG. 4 illustrates a perspective exploded view of the vehicle mounted implement of FIG. 1.

FIG. 4 illustrates an expanded/exploded view of the implement and sliding lateral mount assembly of FIG. 1. As shown, the attachment mount 20 of the sliding lateral mount assembly 10 has a rearward surface that includes mounting elements 22, which are adapted to interconnect to a front bumper of a vehicle. It will be appreciated that different vehicles may utilize different mounting arrangements and therefore the mounting elements 22 are shown by way of example and not by way of limitation. That is, other mounting arrangements may be utilized depending on the configuration of attachment interface of the vehicle. A slide assembly 50 slidably interconnects the moving frame 30 to the attachment mount 20. An implement frame 102 is interconnected to the moving frame via a mounting plate 32 interconnected the front surface of the moving frame 30. In the illustrated embodiment, the implement 100 is a rotary brush assembly that includes a rotary brush 106 that is mounted on a hub assembly 108. A hood or cover 130 is disposed over the rotating brush 106 and is fixedly interconnected to the outside edges of the implement frame 102. To rotate the brush 106, the implement utilizes a drive motor 132 which is interconnected to a gear box 134 disposed within the hub 108. The gear box, hub and brush are supported relative to the implement frame 102 via a support frame 136. In the present embodiment, the drive motor 132 is a hydraulic motor that is interconnected to a hydraulic system of the vehicle (not shown). However, it will be appreciated that other drive motors are possible and within the scope of the presented invention. Upon assembly, the drive motor 132 turns the input shaft of the gearbox 134 which rotates the hub assembly 108 thereby rotating the brush. Further, in the present embodiment, the brush implement 100 includes first and second castors 140 which are utilized to support the implement 100 during interconnection of the implement to a vehicle 110.

Figure 5:
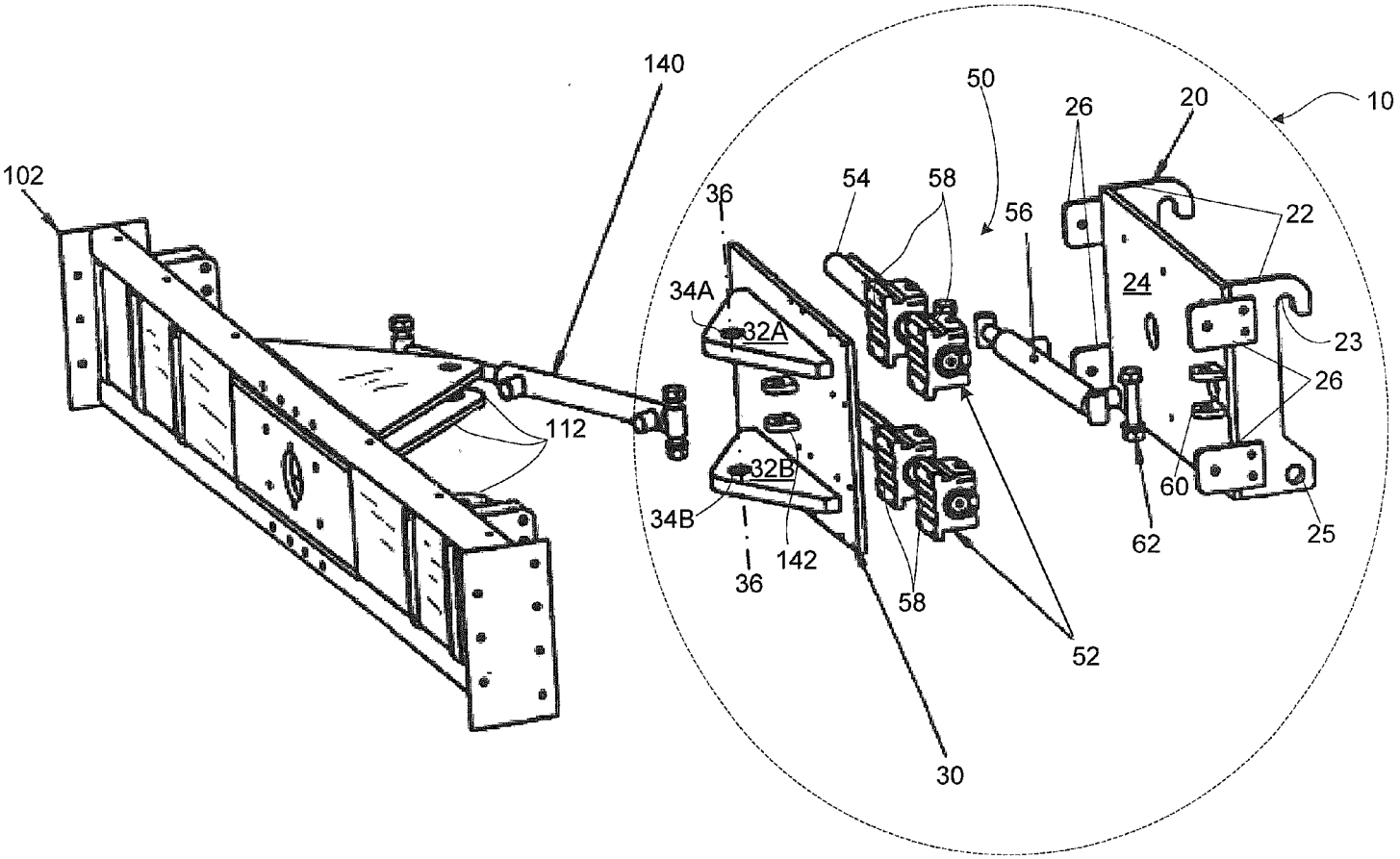
FIG. 5 illustrates a perspective view of a laterally adjustable attachment mount assembly and implement frame of FIG. 4.

FIG. 5 illustrates one embodiment of the sliding lateral mount assembly 10 and the implement frame 102 with the brush implement removed for purposes of clarity. As will be appreciated, the sliding lateral mount assembly may be utilized with any implement frame 102 that supports any of various vehicle mounted implements. In this regard, the implement frame may support a rotating brush as illustrated in FIGS. 1 and 4, a snow plow mould board or other implements. Accordingly, the present figures are provided by way of illustration and not by limitation.

FIGS. 5 and 6A-E more fully illustrate the operation of the lateral slide mount assembly 10. In the present embodiment, the attachment mount 20 is generally formed of a flat plate 24 having first and second attachment or mounting elements 22 interconnected on either end. As shown, the mounting elements 22 extend transversely from the generally planar front surface of the plate 24 and extend rearward. In the present embodiment, the mounting elements 22 each include a hook 23 that is adapted to be disposed over the top of a mounting plate attached to a vehicle. Further, these mounting elements 22 may include one or more apertures 25 that allow for securing (e.g., bolting) the attachment mount 20 to the mounting plate on the front end of a vehicle. The attachment mount 20 further includes multiple slide support members 26 that are connected to the ends of the flat plate 24 and extend in a forward direction. In the present embodiment, the attachment mount 20 includes four slide support members 26 that are adapted to support first and second slide members.

Figure 6A:
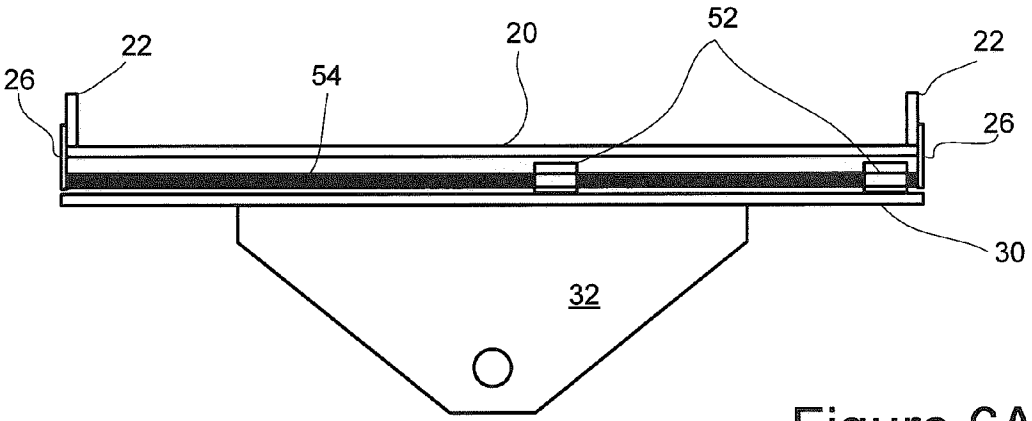
FIGS. 6A and 6B illustrate a top view of the laterally adjustable attachment mount assembly of FIG. 5.
Figure 6B:
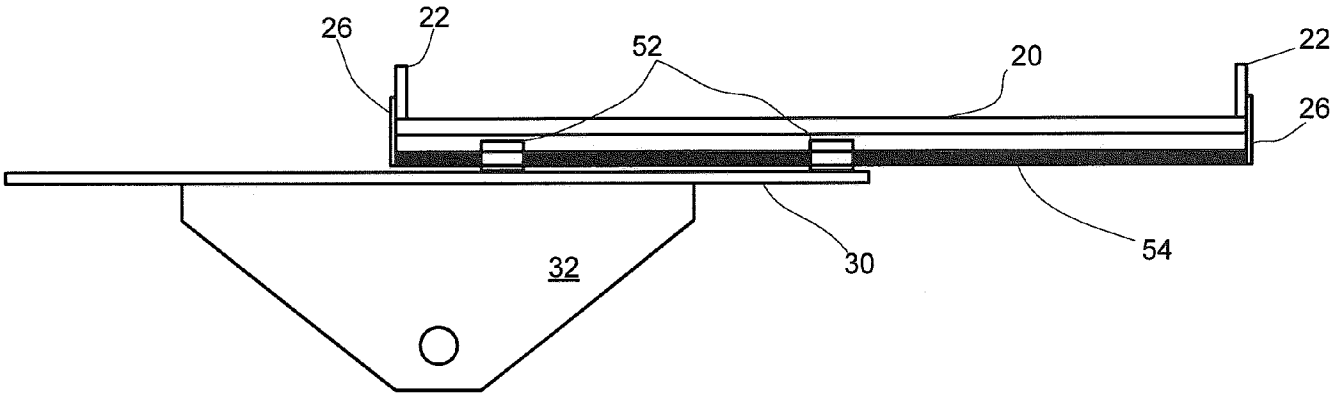

As shown, the slide support members 26 are adapted to support first and second slide assemblies 50 or tracks. In the present embodiment, each slide assembly is formed of a shaft 54 and one or more linear bearings 52 that move along the length of the shaft 54. However, the slide assemblies 50 may be formed of any elements that allow for movement of a first member relative to a second member. Stated otherwise, the slide assembly may be formed of any track and carriage arrangement that allows for movement of the carriage between first and second positions along the length of the track. In the present embodiment, once the shaft 54 is disposed through the linear bearings 52, the linear bearings 52 cannot be removed from the shaft but can move along the length of the shaft. The shafts 54 have a length that allows for their disposition between the slide support members 26 of the attachment mount 20. Once so disposed, the shafts 54 are fixedly interconnected to the attachment mount 20 utilizing bolts that pass through the slide support members 26 and into the ends of the shafts 54. Once the first and second ends of the shafts 54 are disposed between the slide support members 26 and bolted in place, bodies of the shafts 54 are suspended above the front surface of attachment mount 20 as is best shown in FIGS. 6A and 6B.

Figure 6C:
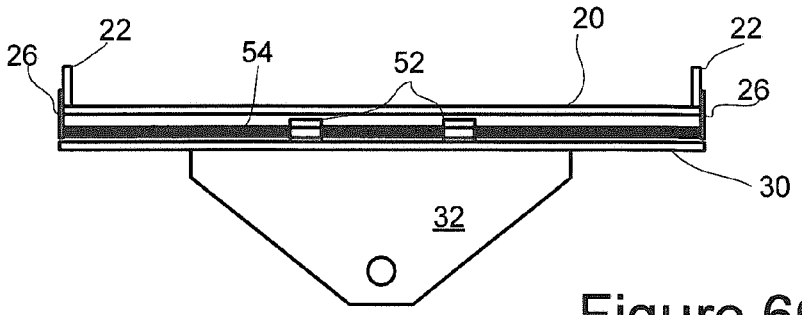
FIGS. 6C, 6D and 6E illustrate a top view of an alternate embodiment of the laterally adjustable attachment mount assembly of FIG. 5.
Figure 6D:
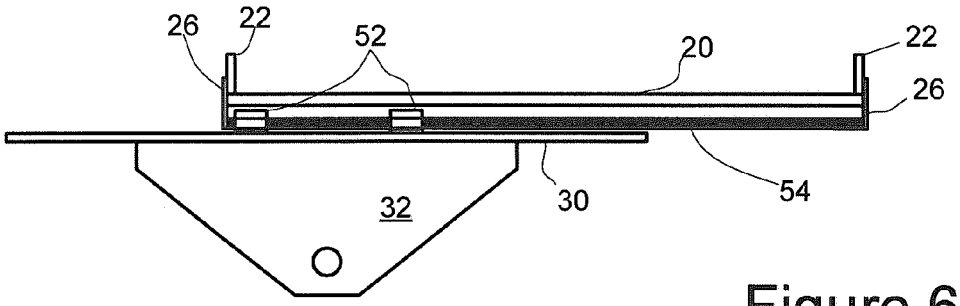
Figure 6E:
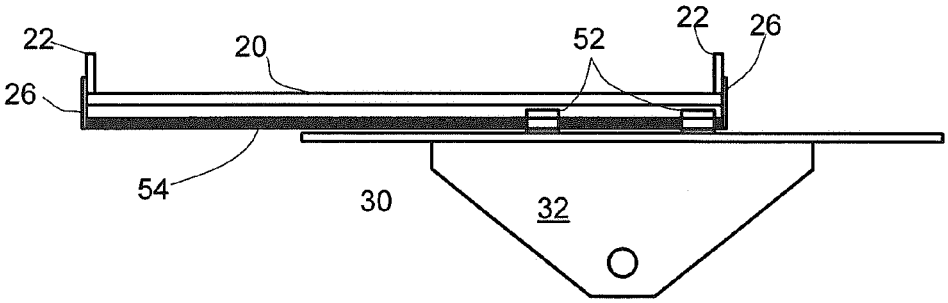

Referring again to FIG. 5, the linear bearings 52 each have a mounting surface 58 on their forward surface. A rearward surface of the moving frame 30 engages the mounting surfaces of the linear bearings 52. As shown, the moving frame 30 is formed of a generally planar surface (e.g., plate) and includes various apertures that allow for bolting the moving frame 30 to each of the linear bearings 52. Once bolted to the linear bearings 52, the moving frame 30 is supported relative to the attachment mount 20 via the slide assembly 50. Furthermore, the moving frame 30 is allowed to move between a first position and a second position in conjunction with movement of the linear bearings from a first position to a second position along the shaft 54. As shown in FIG. 6A, the moving frame 30 is disposed in a home position relative to the attachment mount 20. As shown in FIG. 6B, the moving frame 60 is offset from the attachment mount 20. Accordingly, any implements interconnected to the moving frame 30 are likewise offset from the attachment mount 20 and hence the front end of the vehicle to which the attachment mount 20 is connected. FIGS. 6C, 6D and 6C illustrate an alternate embodiment. In this embodiment, the home position is centered relative to the attachment mount 20. See FIG. 6C. This allows the moving frame 30 to move in a first direction (see FIG. 6D) and a second direction (See FIG. 6E) relative to the attachment mount 20. As will be appreciated, this embodiment allows an implement to be moved either direction relative to the front end of a vehicle.

In order to control the offset between the moving frame 30 and the attachment mount 20, the lateral slide mount assembly 10 utilizes a linear actuator 56. See FIG. 5. As shown, the actuator has a first end that is interconnected to the attachment mount 20 via a first bracket 60 and a bolt 62, likewise, a second end of the actuator 56 is interconnected to a rearward surface of the moving frame 30 (not shown). In the present embodiment, the linear actuator 56 is a hydraulic cylinder which is interconnected to a hydraulic system of the vehicle (not shown) and is controllable by an operator of the vehicle 110. Accordingly, the operator may selectively displace the moving frame 30 relative to the attachment mount 20 and thereby controllably displace the lateral position of an implement 100 relative to the front end of a vehicle. In other embodiments, a rack and pinion assembly may be utilized to move the moving frame relative to the attachment mount. In such an arrangement, the attachment mount and moving frame may incorporate track gears on their facing surfaces and a pinion gear is disposed there between. Such a pinion gear may be operated hydraulically, electrically or mechanically (e.g., via a power take off).

The exact configuration of the slide assembly 50 may be varied for a particular application. As noted above, any appropriate track and carriage arrangement may be utilized. In one embodiment, it is preferred that the slide assembly 50 limit movement of the supported moving frame 30 and implement 100 to a single degree of freedom. That is, it may be preferred that the slide member/assembly 50 limit movement of the moving frame to linear movement and prevent rotational movement about the slide assembly. In the present embodiment, limitation of rotational movement is achieved by utilization of first and second shafts that are disposed in a parallel arrangement. In this regard, once the moving frame 30 is interconnected to the linear bearings 52 on each of the parallel shafts 54, the moving frame 30 is prevented from rotating about the shafts. However, in other embodiments, it may be desired that the moving plate be allowed to rotate relative to the attachment mount 20 in order to allow a further degree of movement (e.g., up and down) between the mounting plate 32 and the attachment mount 20. Such an arrangement may ulitize a single shaft and one or more additional actuators to control up and down movement of the moving frame and an attached implement.

Referring again to FIG. 5, the moving frame 30 provides a mounting surface for attaching the implement frame 102 to the lateral slide mount assembly 10 via first and second mounting plates 32A, 32B are fixedly interconnected (e.g., welded) to a front surface of the moving frame 30. As shown, these mounting plates 32A, 32B are generally triangular and have a base interconnected to the moving frame 30. A forward end of each of these plates 32A, 32B includes a mounting aperture 34A, 34B, which define a pivot axis 36. In the present embodiment, each of these plates 34A, 34B forms a tang of clevis and tang connection. Likewise, the implement frame 102 includes first and second pairs of clevis plates 112 where each pair of clevis plates 112 is sized to be disposed on opposing sides of one of the tangs defined by the mounting plates 32A, 32B of the moving frame 30. The clevis plates 112 each include an aperture that may be aligned with the apertures 34A, 34B through the mounting plates 32. Accordingly, a pin shaft or other element may be disposed through these aligned apertures in order to pivotally interconnect the implement frame 102 relative to the moving frame 30. This pivotal interconnection between the moving frame 30 and implement frame 102 allows the implement frame to move from a first angular orientation relative to the moving frame 30 (e.g., and vehicle) to a second angular orientation. See for example FIGS. 3B and 3C.

In order to control the angular orientation between the implement frame 102 and moving frame 30, a second actuator 140 is utilized. The second actuator 140 in the present embodiment is a hydraulic cylinder having a first end interconnected to a forward surface of the moving frame 30 via a bracket 142 and a second that is interconnected to a rearward surface of the implement frame (not shown). An operator of the vehicle 110 can operate the actuator 140 to selectively move the angular orientation of the implement frame 102 relative to the moving frame 30 and hence the vehicle 110.

Figure 7A:
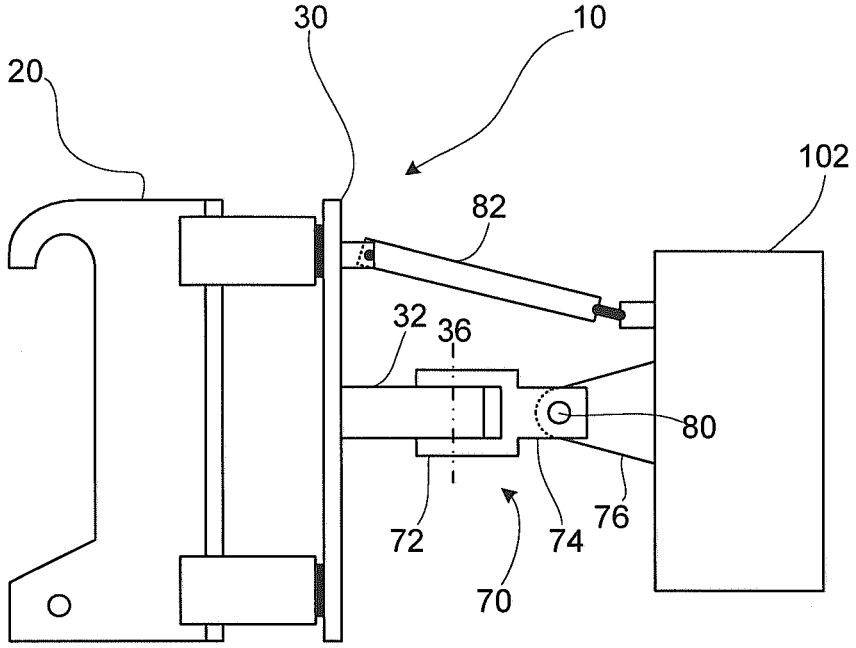
FIGS. 7A and 7B illustrate an alternate embodiment of the laterally adjustable attachment mount assembly.
Figure 7B:
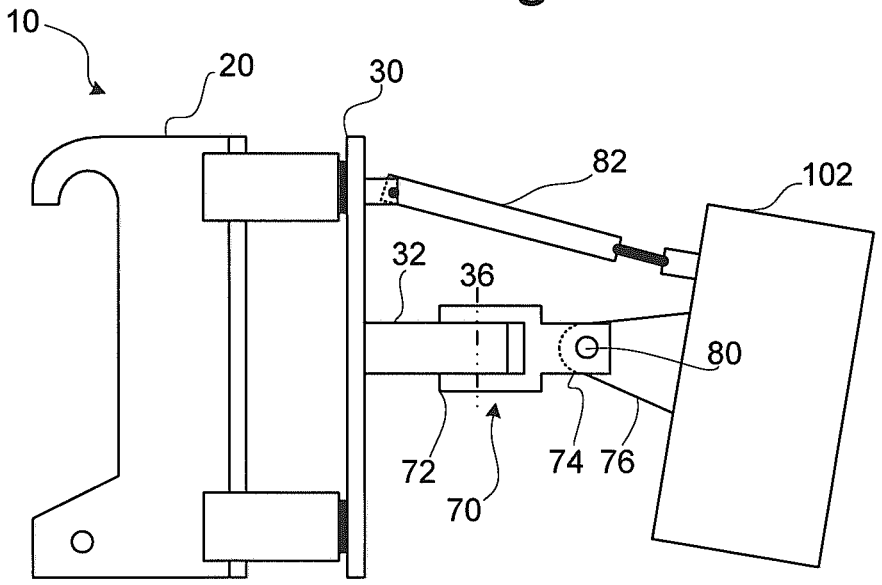

FIGS. 7A and 7B illustrate another embodiment of a lateral slide assembly 10. This embodiment of the lateral slide assembly again allows for lateral movement of a moving frame 30 relative to an attachment mount 20 thereby allowing lateral movement of an implement frame 102 relative to the attachment mount 20 and a vehicle. However, in this embodiment, the moving frame includes a single mounting plate 32. Pivotally interconnected to the mounting plate is a two-axis clevis 70. The two-axis clevis includes a first clevis end 72 that is pivotally attached to the mounting plate 36 about a first pivot axis 36. A second clevis end 74 is pivotally connected to a tang 76 that is fixedly interconnected to a rearward surface of an implement frame 102. The second clevis end 74 and tang 76 allow pivotal movement about a second pivot axis 80. Such movement about this second pivot axis 80 allows for tilting the implement frame relative to the moving frame 30. In this regard, an implement attached to the implement frame 102 may be raised or lowered relative to the front end of a vehicle to which the attachment mount 20 is connected. Another actuator 82 (e.g., hydraulic cylinder) may be interconnected between the moving frame 30 and the implement frame 102 to control such movement. As will be appreciated, the embodiment of the lateral slide assembly illustrated in FIGS. 7A and 7B allows for three axis movement of the implement frame 102 and any attached implement relative to the attachment mount 20. Specifically, the implement frame may be moved laterally (see e.g., FIG. 3B) along the slide member (not shown), pivoted about the first pivot axis 36 (see e.g., FIG. 3C) and/or raised or lowered about the second pivot axis 80 (see FIG. 7B).

In addition to being utilized with original equipment manufacturer (OEM) implements, the lateral slide assembly may be retrofit with existing implements. That is, the existing attachment mount of an implement may be removed and replaced with the attachment mount 20, slide assembly 50 and moving frame 30 of the lateral slide assembly 10. In this regard, existing implements may be converted to utilize the lateral slide assembly and thereby realize the benefits of the same.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions.

It is intended that the appended claims be construed to include alternative embodiments to the extent permitted by the prior art.

What is claimed is:

1. A mount assembly for providing lateral movement between a vehicle and an implement attached to the vehicle, comprising:

an attachment mount having a rearward surface adapted for removable attachment to said vehicle;

a track fixedly connected to a forward surface of said attachment mount, said track extending laterally across said forward surface of said attachment mount;

a slide member movably attached to said track, wherein said slide member is adapted to move between a first lateral position and a second lateral position along a length of said track and relative to said attachment mount;

a moving frame having a rearward surface fixedly connected to said slide member, wherein said moving frame is adapted to move between said first and second lateral positions relative to said attachment mount;

a first actuator operative to move said moving frame between said first lateral position and said second lateral position;

a mounting surface disposed on a forward surface of said moving frame for selectively mounting said implement to said moving frame, wherein said implement is connected to said mounting surface on said forward surface of said moving frame, and wherein said implement is adapted to move between a first angular position and a second angular position relative to said moving frame; and a second actuator operative to move said implement between said first angular position and said second angular position, wherein said implement is pivotally connected to said moving frame about a vertical axis, and wherein said vertical axis is transverse to a first horizontal reference axis defined by the movement direction of the moving frame between the first and second lateral position.

2. The apparatus of claim 1, wherein, said slide member maintains a single degree of freedom, in a direction along the length of said track, between said moving frame and said attachment mount.

3. The apparatus of claim 1, wherein said slide member comprises a shaft having first and second portions attached to said attachment frame and a body extending between said first and second portions, wherein said body is spaced from said front surface of said attachment frame.

4. The apparatus of claim 3, wherein said slide member comprises at least one linear bearing.

5. The apparatus of claim 4, wherein said movable frame is fixedly connected to each of said at least one linear bearing.

6. The apparatus of claim 3, wherein said slide member comprises first and second parallel shafts and at least one linear bearing movably attached to each of said parallel shafts.

7. The apparatus of claim 1, wherein said implement is movably connected to said moving frame about a second horizontal axis, wherein said implement is adapted to move between a third angular position and a fourth angular position relative to said moving frame, wherein said first horizontal reference axis and said second horizontal reference axis are substantially parallel.

8. The apparatus of Claim 1, wherein said implement comprises one of:

a rotating brush; and a snow plow.

9. The apparatus of claim 1, wherein said first actuator comprises a linear actuator having a first end connected to said attachment mount and a second end attached to said moving frame.

10. The apparatus of claim 9, wherein said first actuator comprises a hydraulic actuator.

11. A mount assembly for providing lateral movement between a vehicle and an implement attached to the vehicle, comprising:

a mounting plate having a rearward surface adapted for removable attachment to said vehicle, wherein upon attachment to said vehicle said mounting plate is in a fixed spatial relationship with said vehicle;

a moving frame having a rearward portion movably attached to a forward surface of said mounting plate, wherein said moving frame moves between a first lateral position and a second lateral position relative to said mounting plate;

a first actuator operative to move said moving frame between said first lateral position and said second lateral position;

an implement frame pivotally connected to -a forward surface of said moving frame, wherein said implement frame is adapted to move between a first angular position and a second angular position relative to said movable frame; and a second actuator operative to move said implement frame between said first angular position and said second angular position, wherein said implement frame is pivotally connected to said moving frame about a vertical axis, and wherein said vertical axis is transverse to a first horizontal reference axis defined by the movement direction of the moving frame between the first and second lateral positions.

12. The apparatus of claim 11, further comprising:

a slide member disposed between said mounting plate and said movable frame, wherein said slide member is fixedly attached proximate to a forward surface of said mounting plate and is adapted to move between said first lateral position and said second lateral position, wherein said movable frame is fixedly attached to said slide member.

13. The apparatus of claim 12, wherein said slide member comprises:

a track fixedly connected to a forward surface of said mounting plate, said track extending laterally across said forward surface of said mounting plate;

a carriage movably attached to said track, wherein said carriage is adapted to move between said first lateral position and said second lateral position along a length of said track, wherein said movable frame is fixedly attached to said carriage.

14. The apparatus of claim 13, wherein said track comprises at least one shaft having first and second portions attached to said mounting plate and a body extending between said first and second portions, wherein said body is spaced from said front surface of said mounting plate and wherein said carriage comprises at least one linear bearing.

15. The apparatus of claim 11, wherein said implement frame further comprises one of:

a rotating brush; and a snow plow.

16. The apparatus of claim 11, wherein said moving frame further comprises at least one of a clevis and a tang attached to a front surface of said moving frame and defining a pivot axis disposed in front of said moving frame.

17. The apparatus of claim 16, wherein said implement frame further comprises at least one of a tang and a clevis adapted for mating engagement with one of said clevis and said tang of said moving frame, wherein the tang or clevis of said implement frame extends rearward of said implement frame.

* * * * *